US006471324B1

(12) United States Patent
Maru

(10) Patent No.: US 6,471,324 B1
(45) Date of Patent: Oct. 29, 2002

(54) PRINTHEAD WITH MALFUNCTION PREVENTION FUNCTION AND PRINTING APPARATUS USING IT

(75) Inventor: Hiroyuki Maru, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/437,321

(22) Filed: Nov. 10, 1999

(30) Foreign Application Priority Data

Nov. 11, 1998 (JP) ..... 10-320947

(51) Int. Cl.[7] ..... B41J 29/393
(52) U.S. Cl. ..... 347/19
(58) Field of Search ..... 347/5, 9, 19; 400/74, 400/62

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,595,821 A | * | 6/1986 | Matsuura | 347/209 |
| 4,723,129 A | | 2/1988 | Endo et al. | 346/1.1 |
| 4,740,796 A | | 4/1988 | Endo et al. | 346/1.1 |
| 5,114,252 A | * | 5/1992 | Tanuma et al. | 400/124.03 |
| 5,602,576 A | | 2/1997 | Murooka et al. | 347/59 |
| 5,610,635 A | * | 3/1997 | Murray et al. | 347/19 |
| 5,828,386 A | * | 10/1998 | Okada et al. | 347/9 |
| 5,929,672 A | * | 7/1999 | Mitani | 327/143 |

FOREIGN PATENT DOCUMENTS

| | | |
|---|---|---|
| JP | 59-123670 | 7/1984 |
| JP | 59-138461 | 8/1984 |
| JP | 5-185594 | 7/1993 |

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

A printhead and a printing apparatus using the printhead capable of protecting the printhead without causing malfunction in the printhead even if electrical connection between the printing apparatus and the printhead is cut off for some reason. A VDD monitor 400 monitors a voltage supplied via a pad 315 to a cutoff-function added level converter function 121 to perform drive control on a heater 301. The operation of a power transistor 302 to drive the heater 301 is forcefully turned OFF in accordance with the result of monitoring.

14 Claims, 17 Drawing Sheets

PRINTHEAD WITH MALFUNCTION PREVENTION FUNCTION AND PRINTING APPARATUS USING IT

BACKGROUND OF THE INVENTION

This invention relates to a printhead and a printing apparatus using the printhead, and more particularly, to an ink-jet printhead with a malfunction prevention function and a printing apparatus using the printhead.

In a conventional printhead to perform printing in accordance with an ink-jet method, an electrothermal transducer (heater) and a driver for the transducers are formed on the same substrate by using a semiconductor process technique, as disclosed in Japanese Patent Publication Laid Open No. 5-185594.

This printhead is mounted on a carriage of a printing apparatus, receives various control signals and an image signal from the printing apparatus, and operates based on the received signals. When the printhead is attached to the carriage, contacts provided in the printhead and contacts provided in the carriage are pressed into contact and electrical connection is established therebetween, then signals are supplied from the printing apparatus to the printhead.

To establish the electrical connection between the printhead and the printing apparatus, conventionally, needles for contacts are provided on the printing apparatus main body side on which the printhead is mounted, and the contacts of the printhead are pressed against the needles.

However, if a part of the electrical connection between the contacts is cut off due to some reason such as vibration of the apparatus or an error in attachment of the printhead to the carriage, heat generation by the heater not based on image data (i.e., erroneous ink discharge) and breakage of the heater due to the heat generation might occur.

Specifically, if an electrical connection is cut off by positional shift of the contacts of the printhead and the carriage or the like, there is a possibility that only the power supply voltage (VH) to the printhead is connected but the printhead cannot not be controlled. If such a trouble occurs, the power transistor might be continuously turned on, and at the worst, the heater might be heavily damaged.

SUMMARY OF THE INVENTION

Accordingly, it is an object of the present invention to provide a printhead and a printing apparatus using the printhead which protect the printhead without causing the printhead to malfunction even if an electrical connection between the printhead and the printing apparatus holding the printhead is accidentally cut off for some reason.

According to one aspect of the present invention, the foregoing object is attained by providing a printhead, supplied with a control signal, print data and electric power supplied via a plurality of electrical contacts, for performing printing operation, comprising: a printing element; a first contact that inputs a voltage to drive the printing element; a control circuit that performs drive control on the printing element; a second contact that inputs a voltage to drive the control circuit; a monitoring circuit that monitors the voltage in the second contact; and a protection circuit that forcefully stops the drive control on the printing element by the controller, in accordance with the result of monitoring by the monitoring circuit.

Preferably, the printing element includes a heater and a power transistor to electrify the heater, and the heater heats ink to cause film boiling in the ink and discharge the ink by a pressure of a bubble generated by the film boiling.

Further, it is preferable that the printhead further comprises: a third contact that inputs print data; and a memory circuit that is used for temporarily storing the print data inputted via the third contact. In this case, the control circuit inputs a signal representing the print data stored in the memory circuit and amplifies the voltage of the signal. The control circuit is a CMOS circuit comprising a PMOS transistor and an NMOS transistor.

Further, it may be arranged such that the protection circuit includes an analog switch and a PMOS transistor, and the analog switch cuts off an output from the control circuit in accordance with the result of monitoring from the monitoring circuit, on the other hand, the PMOS transistor forcefully turns off an output to the printing element; or it may be arranged such that the protection circuit includes a switch comprising a pair of a first PMOS transistor and an NMOS transistor and a second PMOS transistor, and the switch comprising the pair of the first PMOS transistor and the NMOS transistor cuts off an output from the control circuit in accordance with the result of monitoring from the monitoring circuit, on the other hand, the second PMOS transistor forcefully turns off an output to the printing element.

Further, it may be arranged such that the monitoring circuit operates by the voltage inputted from the first contact, and the monitoring circuit comprises a plurality of inverter circuits connected to the second contact and a pull-down resistor connected to the second contact; or it may be such that the monitoring circuit comprises a comparator having a first terminal connected to the second contact and a second terminal to input a voltage obtained by dividing the voltage inputted from the first contact by serially-connected first and second resistors, and a pull-down resistor connected to the second contact.

According to another aspect of the present invention, the foregoing object is attained by providing a printing apparatus using a printhead having the above construction.

In accordance with the present invention as described above, the voltage supplied to the control circuit to perform the drive control on the printing element via the second contact is monitored, and in accordance with the result of monitoring, the drive control on the printing elements by the control circuit is forcefully stopped.

The present invention is particularly advantageous since malfunction of the printing element caused by poor contact can be prevented.

For example, in a case where the printing element includes the heater, breakage of the heater and its driving circuit due to heat generation and overheating by malfunction can be prevented.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Outline of Apparatus Main Body>

Figure 1:
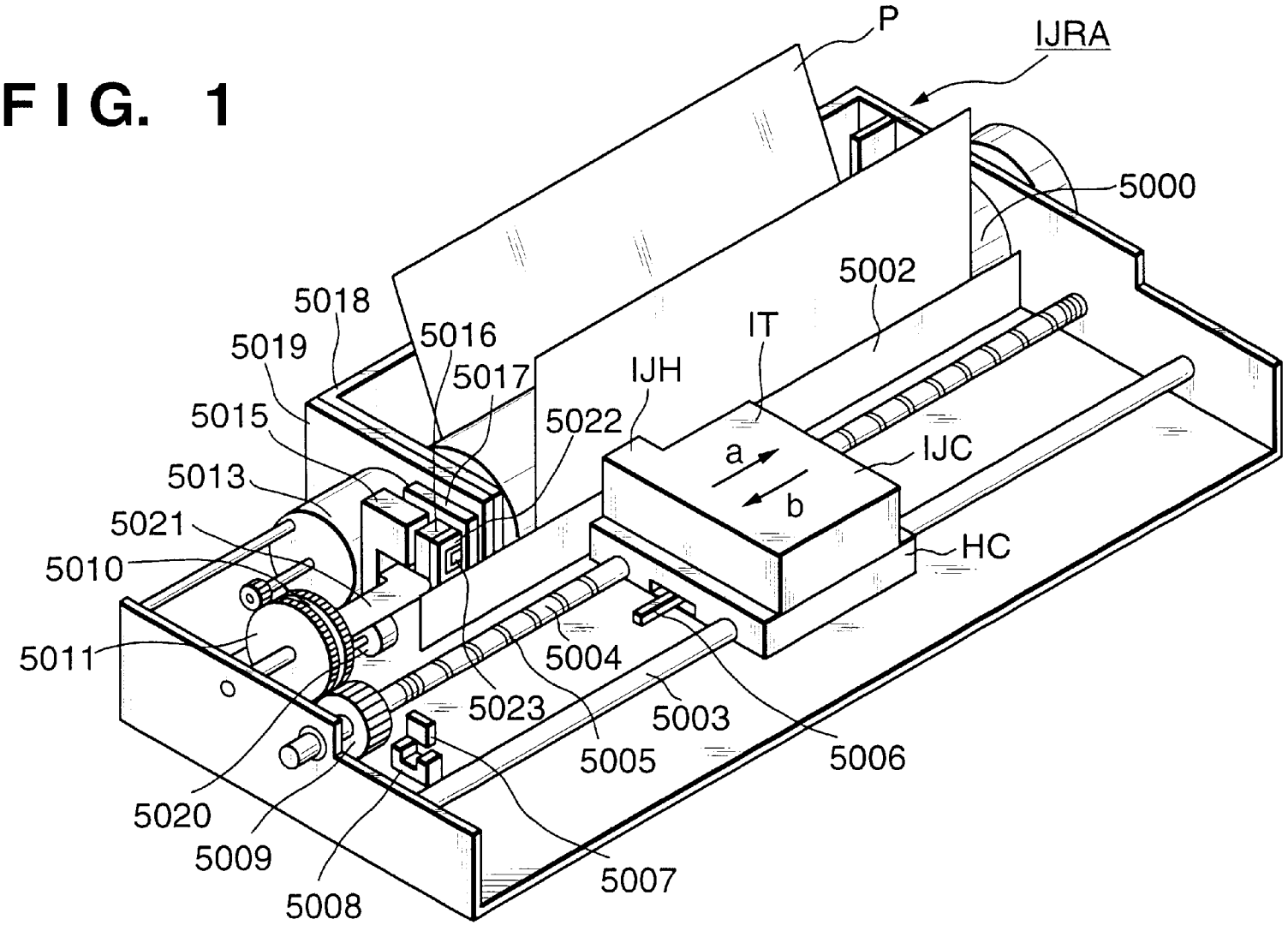
FIG. 1 is a perspective view showing the structure of an ink-jet printer IJRA as a typical embodiment of the present invention.

FIG. 1 is a perspective view showing the structure of an ink-jet printer IJRA as a typical embodiment of the present invention. In FIG. 1, a carriage HC is engaged with a spiral groove 5004 of a lead screw 5005 which rotates via drive force transmission gears 5009 to 5011 interlocking with forward/reverse rotation of a driving motor 5013. The carriage HC has a pin (not shown) and it reciprocates in directions represented by arrows a and b, held by a guide rail 5003. The carriage HC has an ink-jet cartridge IJC which integrally comprises a printhead IJH and an ink tank IT. A paper holding plate 5002 presses a print sheet P against a platen 5000 along the moving direction of the carriage HC. Photocouplers 5007 and 5008 are home position detecting members for confirming the existence of lever 5006 of the carriage in this area and changing over the rotational direction of the motor 5013. A support member 5016 supports a cap member 5022 for capping the front surface of the printhead IJH. A suction member 5015 performs suction-recovery on the printhead via a cap inner opening 5023. A member 5019 allows a cleaning blade 5017 to move in a back-and-forth direction. A main body support plate 5018 supports the member 5019 and the cleaning blade 5017. It is apparent that any well-known cleaning blade is applicable to the embodiment. Numeral 5021 denotes a lever for starting the sucking operation of the suction-recovery. The lever 5021 moves along the movement of a cam 5020 engaged with the carriage HC. A well-known transmission mechanism such as change-over of a clutch controls a drive force from the driving motor.

When the carriage HC comes to the home position area, a desired one of these capping, cleaning and suction-recovery is executed at its corresponding position by the lead screw 5005. The timing of any of these processings is not limited to the printer of the embodiments, if a desired processing is performed at a well-known timing.

<Construction of Controller>

Next, the construction of a controller for executing print-control of the above printing apparatus will be described.

Figure 2:
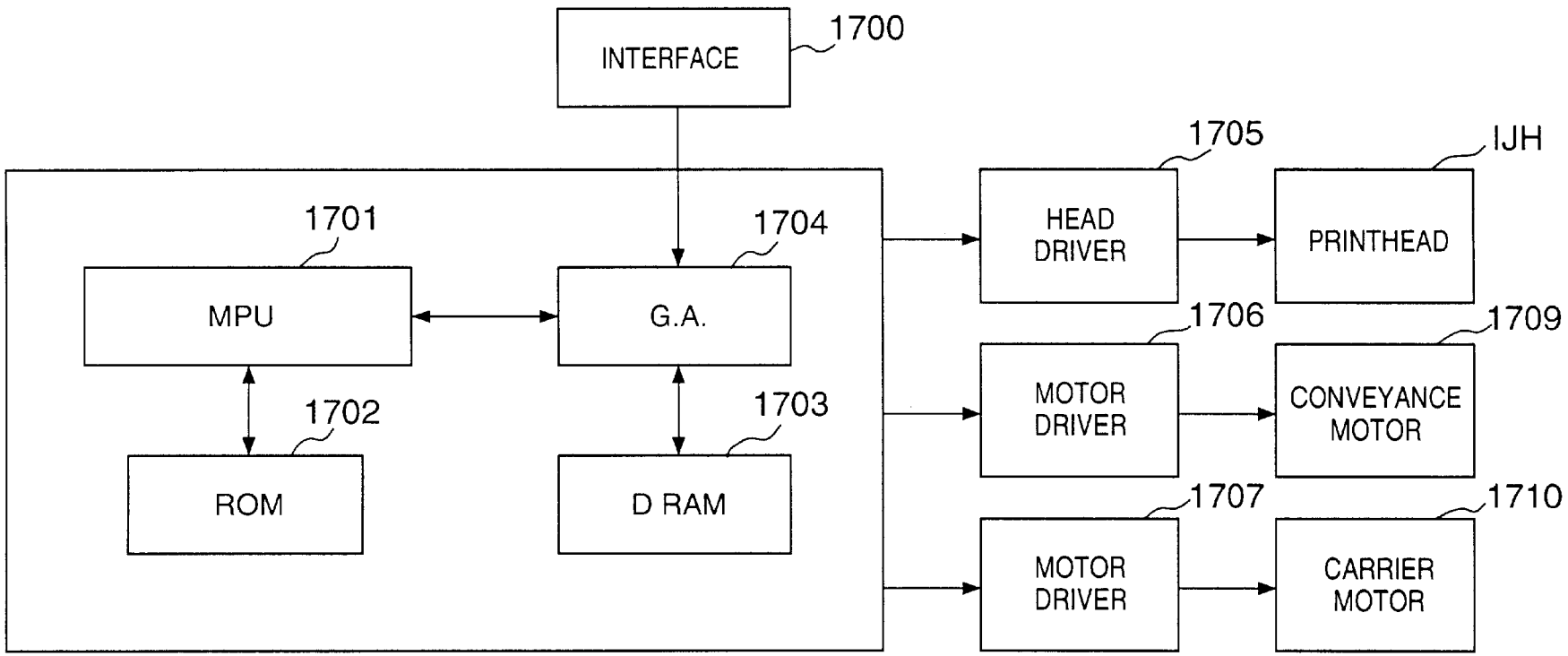
FIG. 2 is a block diagram showing the construction of a control circuit of the ink-jet printer IJRA.

FIG. 2 is a block diagram showing the construction of a control circuit of the ink-jet printer IJRA. Referring to FIG. 2 showing the control circuit, reference numeral 1700 denotes an interface for inputting a print signal; 1701, an MPU; 1702, a ROM for storing a control program executed by the MPU 1701; and 1703, a DRAM for storing various data (an image signal, image data supplied to the printhead and the like). Numeral 1704 denotes a gate array (G.A.) for controlling print data supply to the printhead IJH. The gate array 1704 also performs data-transfer control among the interface 1700, the MPU 1701, and the RAM 1703. Numeral 1710 denotes a carrier motor for transferring the printhead IJH; 1709, a conveyance motor for conveying the print sheet; 1705, a head driver for driving the printhead IJH; and 1706 and 1707, motor drivers for driving the conveyance motor 1709 and the carrier motor 1710.

The operation of the above control construction will be described below. When an image signal is inputted into the interface 1700, the image signal is converted into image data for printing, between the gate array 1704 and the MPU 1701. The motor drivers 1706 and 1707 are driven, and the printhead IJH is driven in accordance with the image data supplied to the head driver 1705, thus performing the printing operation.

Note that as described above, the ink tank IT and the printhead IJH may be integrally formed as an exchangeable ink cartridge IJC. Further, it may be arranged such that the ink tank IT and the printhead IJH can be separated, and when ink is exhausted, only the ink tank IT is exchanged for new one.

Figure 3:
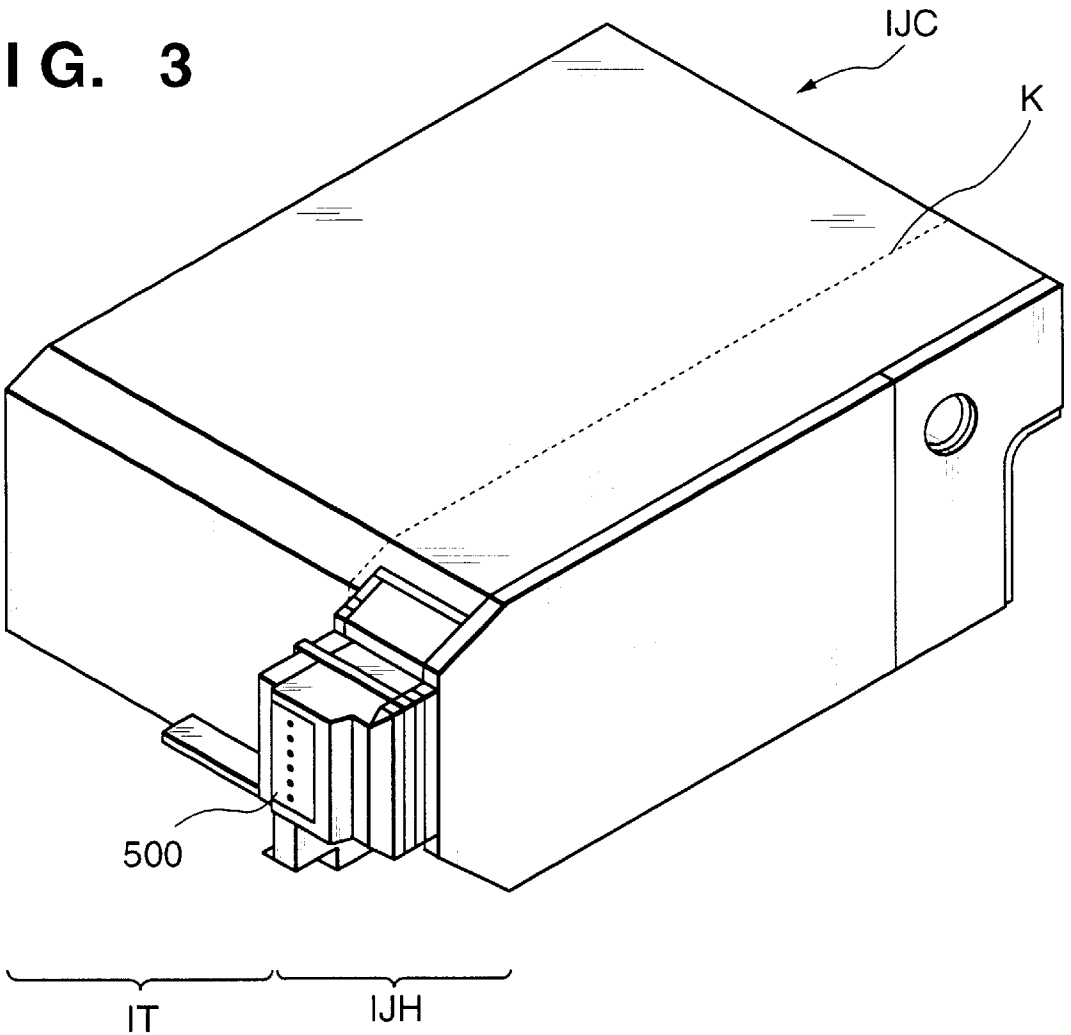
FIG. 3 is a perspective view showing the structure of an ink cartridge IJC in which an ink tank and a head can be separated.

FIG. 3 is a perspective view showing the structure of the ink cartridge IJC in which the ink tank and the head can be separated. As shown in FIG. 3, in the ink cartridge IJC, the ink tank IT and the printhead IJH can be separated along a line K. The ink cartridge IJH has an electrode (not shown) to receive an electric signal supplied from the carriage HC side when the ink cartridge IJC is mounted on the carriage HC. In accordance with the electric signal, the printhead IJH is driven as described above, to discharge ink.

Note that in FIG. 3, numeral 500 denotes an array of ink discharge orifices. Further, the ink tank IT has a fiber or porous ink absorber to hold ink.

Next, the malfunction of the printhead which occurs when the electrical connection between the printhead and the printing apparatus holding the printhead is partially cut off will be studied more specifically.

Figure 11:
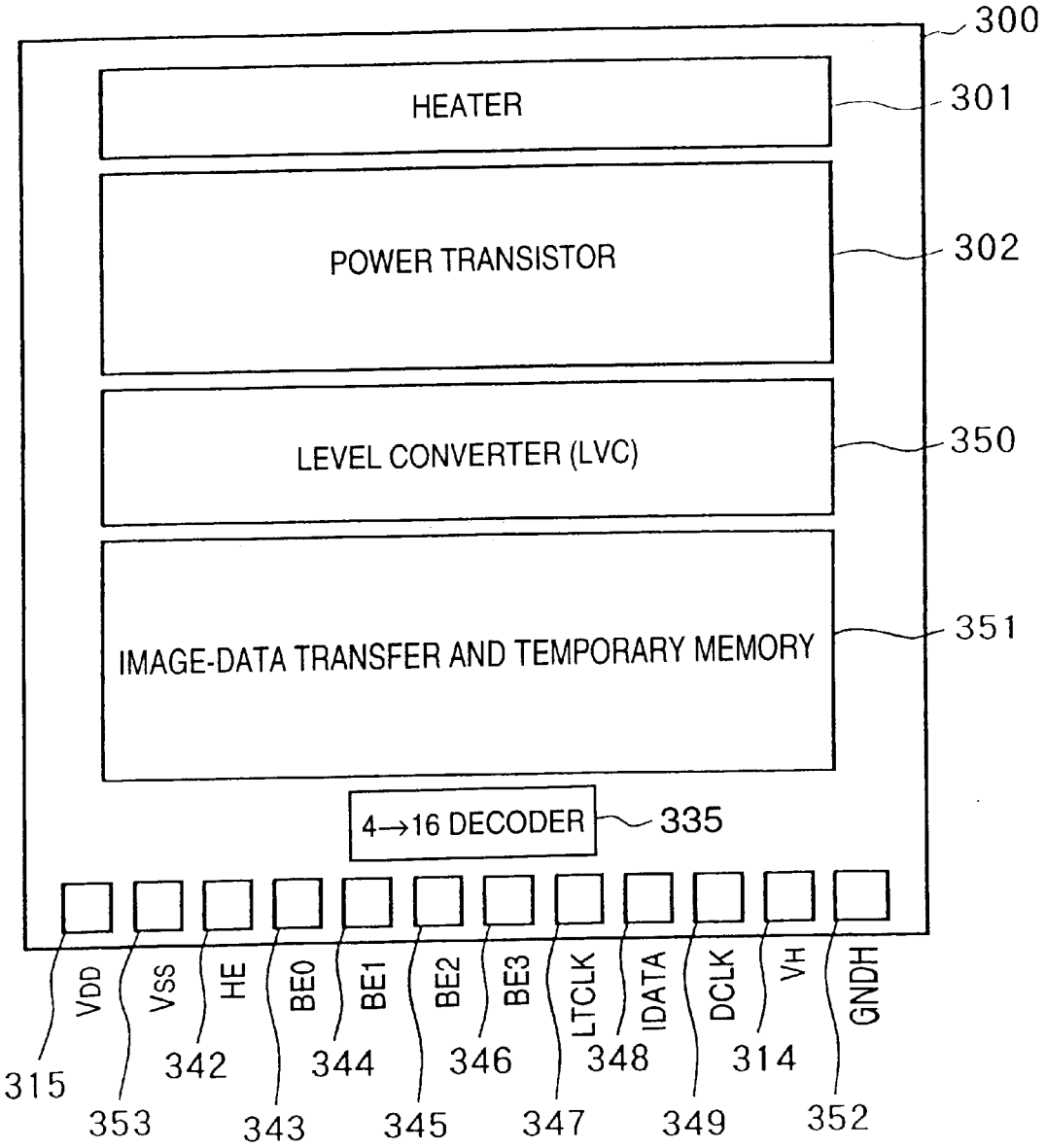
FIG. 11 is a block diagram showing the schematic construction of the driving circuit formed on the same substrate.

FIG. 11 is a block diagram showing the schematic construction of the driving circuit formed on one substrate. The heater is electrified by using this circuit to discharge ink in correspondence with input image data.

As shown in FIG. 11, a heater 301 to heat ink, a power transistor 302 to electrify-drive the heater 301, a level converter (LVC) 350 to regulate a voltage to be inputted into the power transistor 302, an image-data transfer and temporary memory 351, used for temporarily storing image data inputted from the printing apparatus holding the printhead, and used for performing data transfer control in accordance with a control signal inputted with the input image data, and a 4→16 decoder 335 to decode input block enable signals (BE0, BE1, BE2 and BE3), are packaged on one circuit board 300.

Further, pads 314, 315, 342 to 349, 352 and 353 to receive input signals from the printing apparatus, are provided on the circuit board 300. Note that the respective pads have symbols representing the input signals to be described later.

Figure 12:
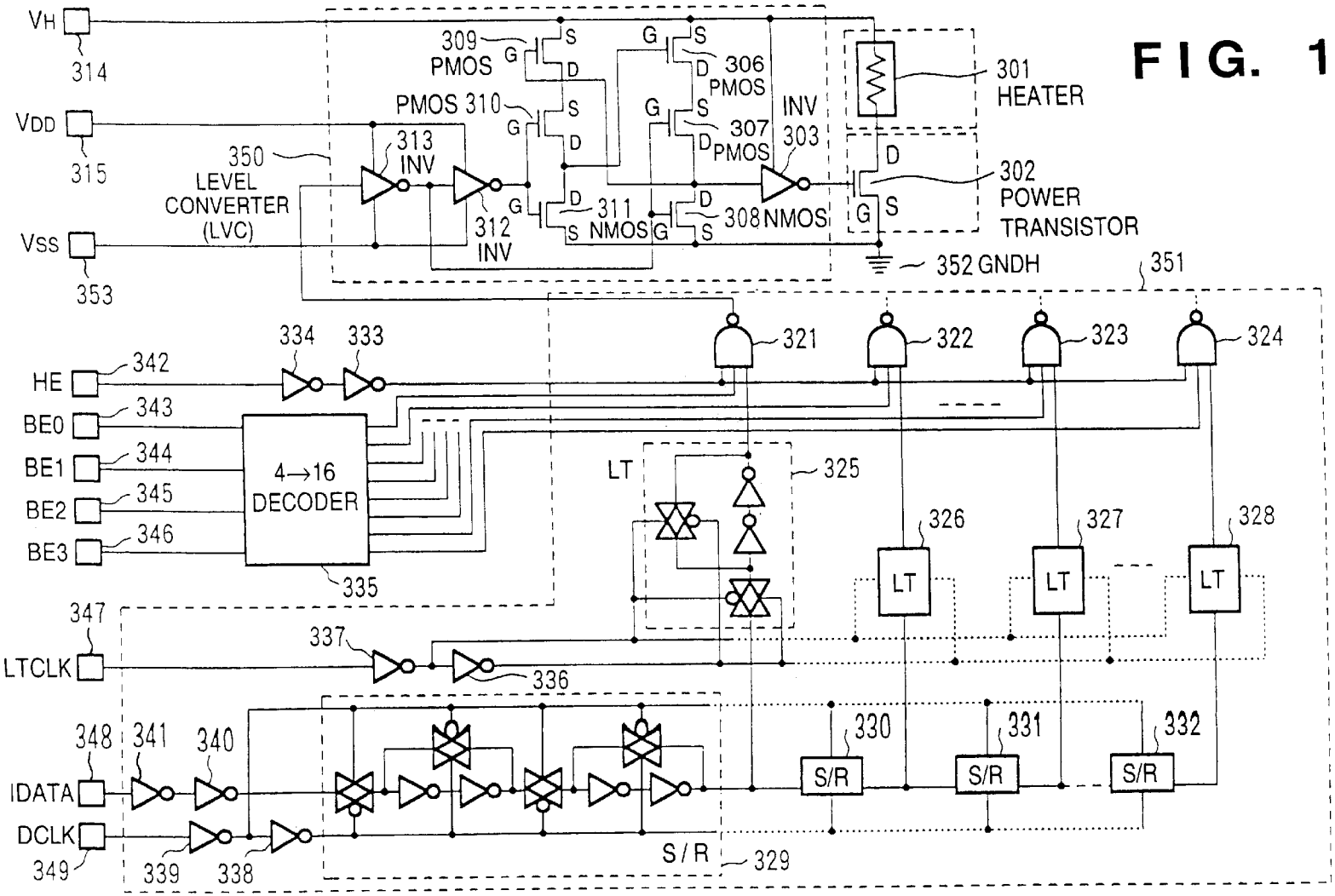
FIG. 12 is a circuit diagram showing the detailed construction of a circuit packaged on a circuit board.
Figure 13:
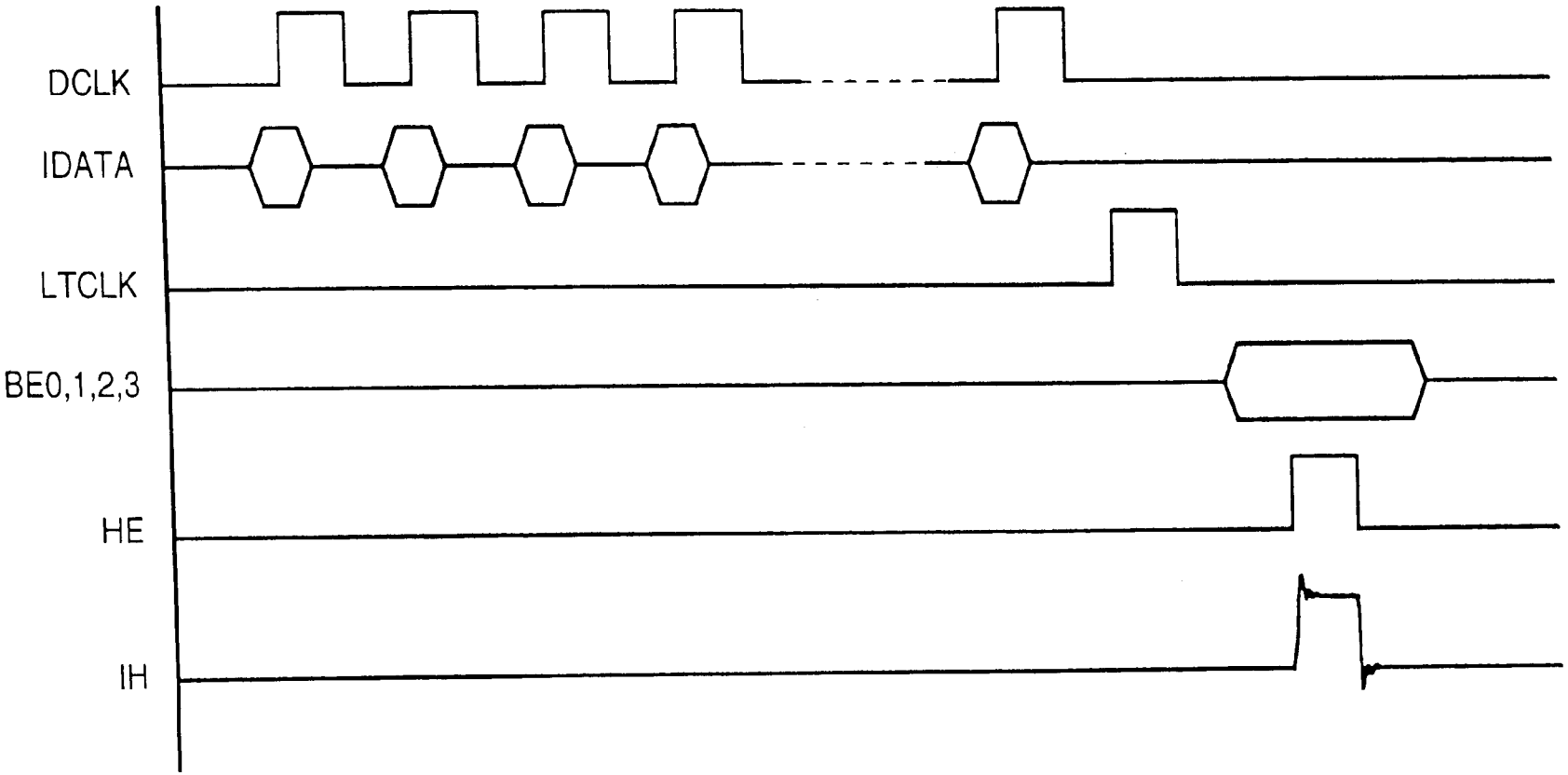
FIG. 13 is a timing chart showing input signals to operate the printhead.

FIG. 12 is a circuit diagram showing the detailed construction of the circuit packaged on the circuit board. FIG. 13 is a timing chart showing the input signals to operate the printhead. Hereinbelow, the operation of the logic circuit packaged on the circuit board will be described with reference to FIGS. 12 and 13.

First, image data (IDATA) transferred from the printing apparatus is serially inputted into the pad 348. The input image data (IDATA) is transferred to shift registers (S/Rs) 329 to 332 in synchronization with the rising edge of a clock (DCLK) pulse inputted into the pad 349. As shown in FIG. 13, at this time, the number of bits of the input image data (IDATA) and the number of pulses of the clock (DCLK) are the same as the number of bits of the shift registers (S/Rs) 329 to 332.

Note that as shown in FIG. 12, inverters (INVs) 340 and 341 are serially connected to the pad 348, forming a buffer circuit to output the image data (IDATA) to the shift registers (S/Rs). Similarly, inverters (INVs) 338 and 339 are serially connected to the pad 349, forming a buffer circuit to generate two signals (DCLK and /DCLK (inverted signal of the DCLK)) based on the input clock (DCLK) from the inverters (INVs) 338 and 339, and to output the signals into the shift registers (S/Rs).

The shift registers (S/Rs) 329 to 332 are serially connected via respective input and output terminals. The clock (DCLK) and the inverted clock (/DCLK) are commonly inputted into the respective shift registers. Further, each shift register (S/R) transfers the image data (IDATA) sequentially to the subsequent shift register (S/R) in synchronization with the rising edge of the clock (DCLK) pulse.

In this manner, when the image data (IDATA) has been transferred to all the bits of the shift registers (S/Rs), a latch clock (LTCLK) is inputted from the pad 347, and the image data (IDATA) is temporarily stored in latch circuits (LTs) 325 to 328, as shown in FIG. 13. Thus, the serially-input image data is converted to parallel data.

As shown in FIG. 12, the signal inputs to the latch circuits (LTs) 325 to 328 are one-to-one connected to the outputs from the shift registers (S/Rs) 329 to 332. The inverters (INVs) 336 and 337 are serially connected to the pad 347 such that the outputs from the inverters (LTCLK, /LTCLK (inverted signal of the latch clock)) are commonly inputted into the latch circuits (LTs) 325 to 328. In this manner, the inverters 336 and 337 are serially connected, forming a buffer circuit to generate the latch clock (LTCLK) and the inverted latch clock (/LTCLK) from the outputs from the inverters.

When the latch clock (LTCLK) pulse is inputted, the inputs of the latch circuits (LTs) 325 to 328 become ON, and the image data stored in the shift registers (S/Rs) 329 to 332 are inputted into the latch circuits at once. When the pulse input has been completed, the inputs of the latch circuits (LTs) 325 to 328 become OFF, and the latch circuits hold the input data. The outputs from the latch circuits (LTs) 325 to 328 are connected to one of 3 inputs of NAND circuits 321 to 324.

The block enable signals (BE0 to BE3), serving as control signals to time-divisionally drive the heaters, are inputted from the pads 343 to 346 into the 4→16 decoder 335. The 4→16 decoder 335 is used for time-dividing the number of heaters which simultaneously discharge ink. To discharge ink by driving all the heaters simultaneously, the amount of current supplied by a power supply voltage VH from the pad 314 must be increased. But to increase the capacity of a power source is to increase the cost of the apparatus. Accordingly, generally, the number of heaters to be simultaneously driven is limited in order to downsize the capacity of the power source, so as to prevent a cost increase.

Figure 14:
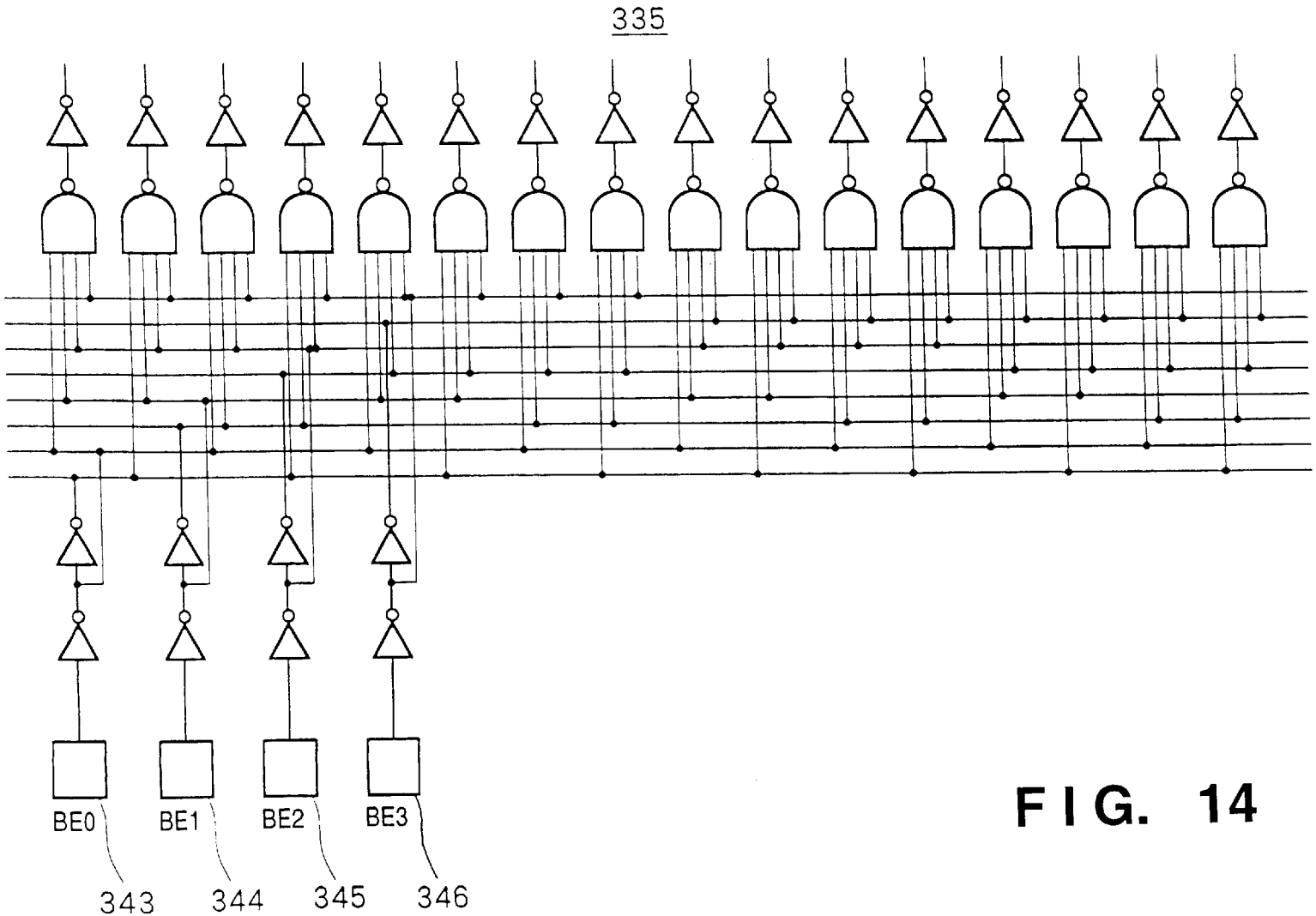
FIG. 14 is a circuit diagram showing the detailed construction of a 4→16 decoder 335.

FIG. 14 is a circuit diagram showing the detailed construction of the 4→16 decoder 335.

As shown in FIG. 14, the decoder comprises 16 inverters, 16 NAND circuits one-to-one connected to the inverters, and 4 pairs of inverters serially connected to the respective pads 343 to 346. The decoder divides the heaters of the printhead into 16 blocks, and always drives any one of these blocks. The 16 outputs from the decoder are inputted into one of 3 inputs of the NAND circuits 321 to 324.

The pad 342 inputs a heat enable signal (HE). Inverters (INVs) 333 and 334 are serially connected to the pad 342, forming a buffer circuit to output the heat enable signal (HE). The output from the inverter (INV) 333 is connected to one of the 3 inputs of the NAND circuits 321 to 324.

Returning to FIG. 12, the output from the NAND circuit 321 is inputted into an inverter (INV) 313. The output from the inverter (INV) 313 is connected to an inverter (INV) 312, the gate of an NMOS transistor 308 and the gate of a PMOS transistor 307. On the other hand, the output from the inverter (INV) 312 is connected to the gate of an NMOS transistor 311 and the gate of a PMOS transistor 310. The source of the NMOS transistor 311 is connected to the GND (pad 352), and the drain of the NMOS transistor 311 is connected to the drain of the PMOS transistor 310 for common output. The source of a PMOS transistor 309 is connected to the pad 314, and the drain of the PMOS transistor 309 is connected to the source of the PMOS transistor 310.

Further, the source of the NMOS transistor 308 is connected to the GND, and the drain of the NMOS transistor 308 is connected to the drain of the PMOS transistor 307 for common output. Further, the source of a PMOS transistor 306 is connected to the pad 314, and the drain of the PMOS transistor 306 is connected to the source of the PMOS transistor 307.

The common output from the drain of the PMOS transistor 310 and the drain of the NMOS transistor 311 is connected to the gate of the PMOS transistor 306. The common output from the drain of the PMOS transistor 307 and the drain of the NMOS transistor 308 is connected to the gate of the PMOS transistor 309 and the input of an inverter (INV) 303.

The output from the inverter (INV) 303 is connected to the gate of the power transistor 302. On the other hand the source of the power transistor 302 is connected to the GND, and the drain of the power transistor 302 is connected to the heater 301. The other terminal of the heater 301 is connected to the pad 314.

In this construction, a block is selected by using the block enable signal (BE0 to BE3), and the heat enable signal (HE) pulse as shown in FIG. 13 is inputted from the pad 312 into the NAND circuits 321 to 324. At this timing, the NAND circuits 321 to 324, in which the value of the image data (IDATA) is "H", generate an output signal.

The output signal is inputted into the LVC (level converter) 350 comprising the inverters (INVs) 303, 313 and 312, the PMOS transistors 306 and 307, the NMOS transistors 308 and 309, the PMOS transistor 310, and the NMOS transistor 311. The input signal in the range 0-VDD is increased to a signal in the range 0-VH. By this increment in the signal level, as the voltage applied to the gate of the power transistor 302 is raised, the resistance when the transistor is turned ON decreases. The level-raised signal passes through the inverter (INV) 303, then turns the power transistor 302 ON. Thus, a current (heater current (IH) as shown in FIG. 13) flows through the heater 301 connected to the power transistor 302 that is turned ON, the heater 301 generates heat to heat ink, then cause film boiling in the ink, and discharge the ink by the pressure of the film boiling.

By the above-described series of processes, ink discharge based on image data (IDATA) is possible.

In the printhead having the above construction, if the electrical connection with the printing apparatus is not correctly held due to some extraneous factor, heat generation by the heaters not based on image data (erroneous ink discharge) and/or breakage of the heaters due to the heat generation might occur.

This problem will be described in more detail with reference to FIGS. 15 to 17C.

Figure 15:
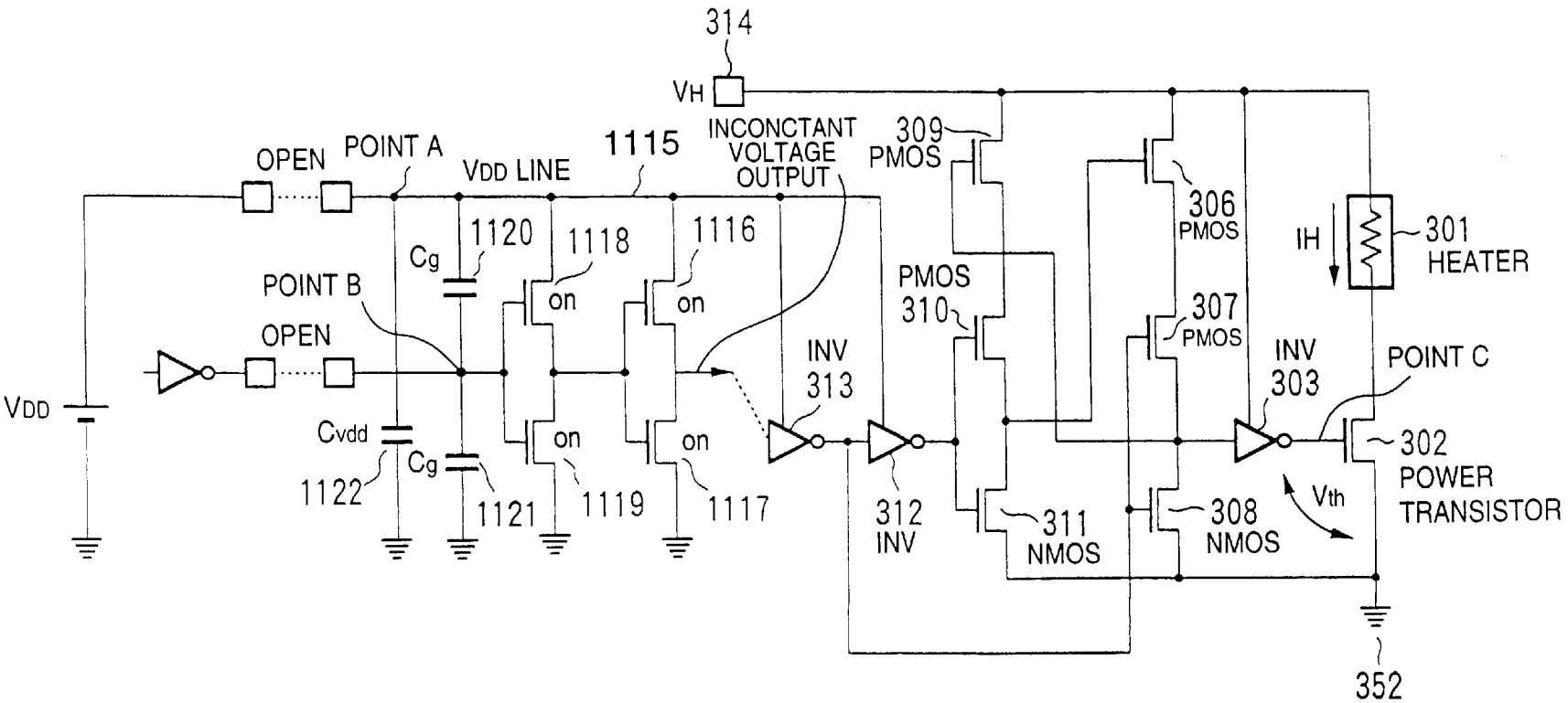
FIG. 15 is a circuit diagram showing the construction at a connection portion between contacts on the printing apparatus side and contacts of the printhead.

FIG. 15 is a circuit diagram showing the construction at a connection portion between contacts on the printing apparatus side and contacts of the printhead. Note that in FIG. 15, the input signal to the inverter (INV) 313, finally generated by the input control signals (DCLK, ITATA, LTSLK, BE0 to BE3 and HE) described in detail with reference to FIG. 12, is formed by a circuit simply comprising a PMOS transistor 1116, an NMOS transistor 1117, a PMOS transistor 1118 and an NMOS transistor 1119.

In FIG. 15, numeral Cg 1120 denotes a parasitic capacitance between the gates of the PMOS transistor 1118 and the NMOS transistor 1119 connected to each other, and a VDD power supply line 1115; Cg 1121, a parasitic capacitance between the gates of the PMOS transistor 1118 and the NMOS transistor 1119 connected to each other, and the GND; and Cvdd 1122, a parasitic capacitance between the VDD line and the GND.

FIG. 15 shows a case where the various signal lines and the VDD power supply line are not electrically correctly connected and are OPEN.

FIGS. 16A to 16D are graphs showing electrical transitional phenomena explaining a malfunction occurred when the contacts between the VDD power source and signal lines are OPEN as shown in FIG. 15.

Figures 16A, 16B, 16C, 16D:
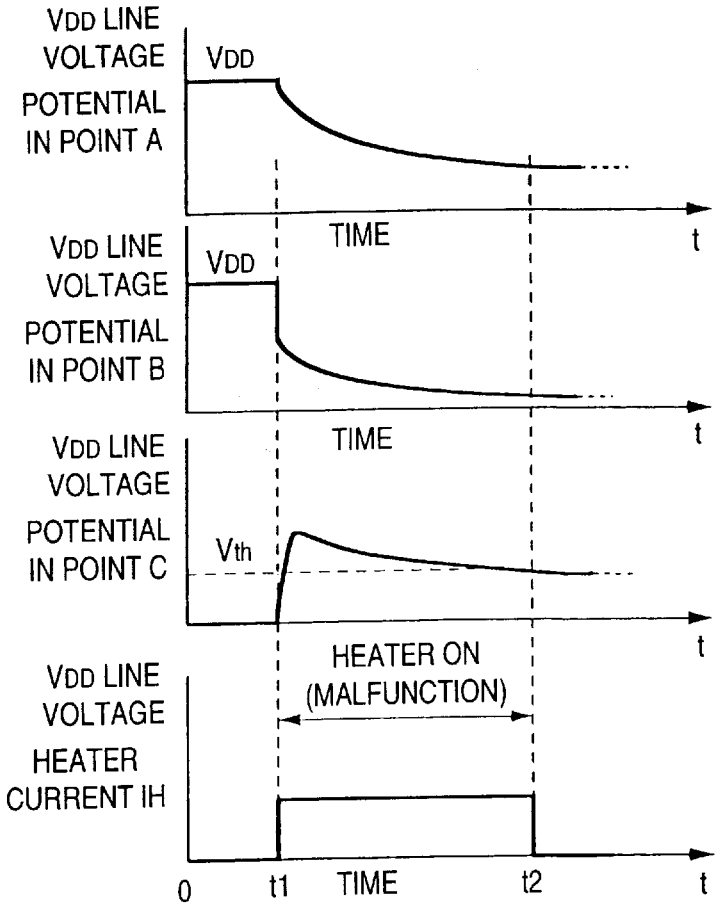
FIGS. 16A to 16D are graphs showing electrical transitional phenomena explaining a malfunction occurred when the contacts of the VDD power source and a signal line as shown in FIG. 15 become OPEN.

FIG. 16A shows a transitional change in potential in a point A of the VDD power supply line 1115 in FIG. 15; FIG. 16B, a transitional change in potential in a point B, between the gates of the PMOS transistor 1118 and the NMOS transistor 1119, capacitance-divided by the parasitic capacitances Cg 1120 and Cg 1121 as shown in FIG. 15; FIG. 16C, a transitional change in potential in a point C at the gate of the power transistor 302 as shown in FIG. 15; and FIG. 16D, a transitional change in the heater current (IH) that flows through the heater 301 as shown in FIG. 15.

Figure 17A:
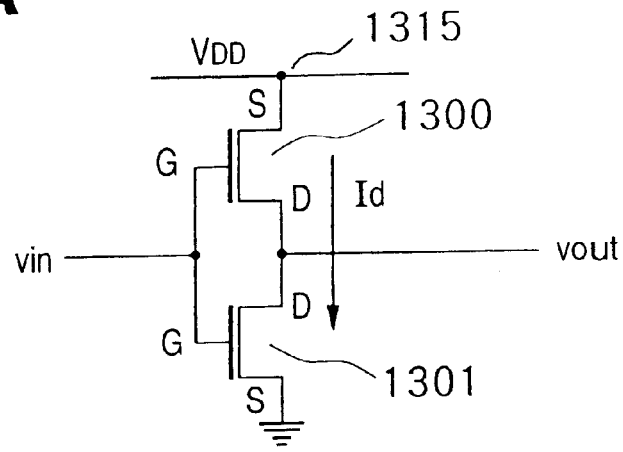
FIGS. 17A to 17C are a diagram and graphs showing the relation between input/output signals in an inverter and a drain current of a MOS transistor constructing the inverter.
Figure 17B:
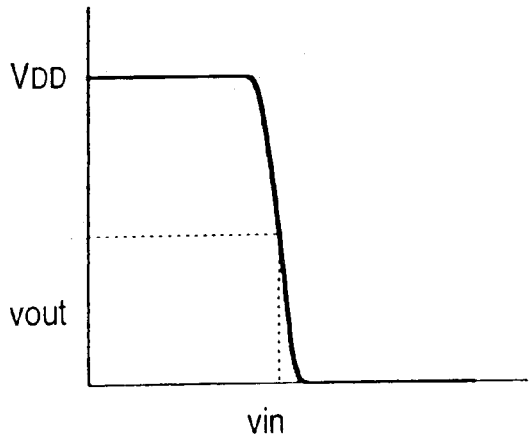
Figure 17C:
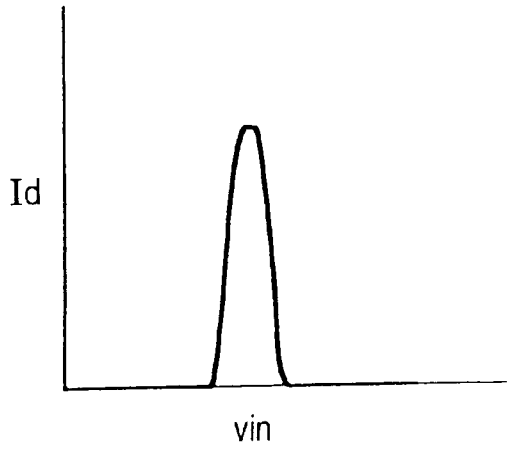

FIGS. 17A to 17C are a diagram and graphs showing the relation between input/output signals in an inverter and a drain current of MOS transistors constructing the inverter.

FIG. 17A shows the construction of an inverter comprising a PMOS transistor 1300 and an NMOS transistor 1301. In this construction, a drain current (Id) flows from a VDD power supply line 1315 in accordance with an input signal voltage (vin), and a drain voltage (vout) is outputted from a common drain of both transistors.

Further, FIG. 17B shows the relation between the input signal voltage (vin) and the output drain voltage (vout). The inverter inputs a voltage in the range from 0 to VDD, and outputs a voltage in the range from VDD to 0. If an intermediate potential in the range 0-VDD is inputted as the input voltage (vin), an intermediate potential in the range VDD-0 is outputted as the output voltage (vout). In this case, as the PMOS transistor 1300 and the NMOS transistor 1301 are turned ON, the ON resistance of the PMOS transistor 1300 and that of the NMOS transistor 1301 are serially connected between the VDD power supply line 1315 and the GND, thus dividing the VDD voltage.

FIG. 17C shows the relation between the input signal voltage (vin) and the drain current (Id). In this figure, when the input signal voltage (vin) is at an intermediate level in the range 0-VDD, the PMOS transistor 1300 and the NMOS transistor 1301 are turned ON, then the drain current flows, and the output voltage (vout) is outputted.

Next, a step-by-step description will be made about the malfunction of the circuit when the VDD power supply line, the control signal lines (HE, BE0-BE3, IDATA, LTCLK and DCLK) are OPEN as shown in FIG. 15.

(1) Status where the electrical connection between the VDD power supply line and the control signal lines is maintained (Section where $0 \leqq t < t1$ holds in FIGS. 16A to 16D)

In this status, the OFF state of the power transistor 302 is maintained.

That is, as shown in FIG. 16A, the potential in the point A is VDD, and as shown in FIG. 16B, the potential in the point B is "High level (H)" (VDD), which logically turns the power transistor 302 OFF. As shown in FIG. 16C, the potential in the point C is a voltage lower than an operation threshold voltage (Vth) of the power transistor 302, which turns the power transistor 302 OFF. As shown in FIG. 16D, the heater current (IH) does not flow due to the OFF state of the power transistor 302.

(2) Immediately after the electrical connection between the VDD power supply line and the control signal lines becomes OPEN (Section where $t1 \leqq t < t2$ holds in FIGS. 16A to 16D)

At the very beginning of the electrical disconnection (t=t1), as shown in FIG. 16A, the potential in the point A is held to the voltage at VDD by the capacitance Cvdd, however, as shown in FIG. 16B, the input terminal to the inverter, formed by the PMOS transistor 1118 and the NMOS transistor 1119, becomes OPEN, and the potential of the input in the point B becomes an intermediate potential of the VDD voltage by capacitance division by the parasitic capacitances Cg 1120 and Cg 1121.

Further, as shown in FIG. 16C, as described above with reference to FIG. 17B, if an intermediate potential in the range 0-VDD is inputted into the inverter comprising the PMOS transistor 1118 and the NMOS transistor 1119, the output voltage (vout) from the inverter becomes an intermediate potential in the range 0-VDD. This applies to all the CMOS logic circuits such as the NAND and NOR circuits as well as the inverter.

The intermediate potential (inconstant voltage) is transferred to all the CMOS logic circuits connected to the VDD power supply line, and finally inputted into the devices constructing the level converter (LVC) 350 connected to the power supply voltage (VH). Similarly, the LVC 350 raises the intermediate potential input to the intermediate potential of the power supply voltage (VH) and outputs the potential. Accordingly, as shown in FIG. 16C, the potential in the point C rises to the intermediate potential of the power supply voltage (VH).

If the raised potential exceeds the operation threshold voltage (Vth) of the power transistor 302, the voltage higher than the operation threshold voltage (Vth) is inputted into the gate of the power transistor 302. The power transistor 302 is turned ON, then a current flows through the heater 301 in error, and the heater 301 generates heat, as shown in FIG. 16D.

(3) When a certain period has elapsed since the electrical connection between the VDD power supply line and the control signal lines became OPEN (Section where $t2 \leqq t$ holds in FIGS. 16A to 16D)

If an intermediate voltage in the range 0-VDD is applied to the CMOS logic circuit connected to the VDD power supply line, the drain current (Id) flows from the VDD power supply voltage 1315 through the GND line (short circuit current) as shown in FIG. 17C. Thus, as shown in FIG. 16A, the electric charge stored in the Cvdd 1122 is started to be discharged, then the voltage of the VDD power supply line 1315 is lowered. Further, as shown in FIG. 16B, with the decrease in the VDD voltage, the intermediate potential (0-VDD) in the point B is lowered. As shown in FIG. 16C, as the intermediate potential in the point B is lowered, the potential in the point C as the output from the LVC 350 is also lowered.

In this voltage drop, when the voltage applied to the power transistor 302 is lower than the operation threshold voltage (Vth), the power transistor 302 is turned OFF. Thus, as shown in FIG. 16D, when the power transistor 302 is turned OFF, the heater current (IH) does not flow.

As described above, when the VDD power supply line and the control signal lines become OPEN, a voltage higher than the operation threshold voltage of the power transistor 302 may be applied to the power transistor. In this case, a current flows through the heater, and erroneous heat generation by the heater, ink discharge by the heat generation, and further, breakage of the heater due to the heat generation may occur.

To solve these problems, the printhead according to the embodiment of the present invention has the following construction.

Figure 4:
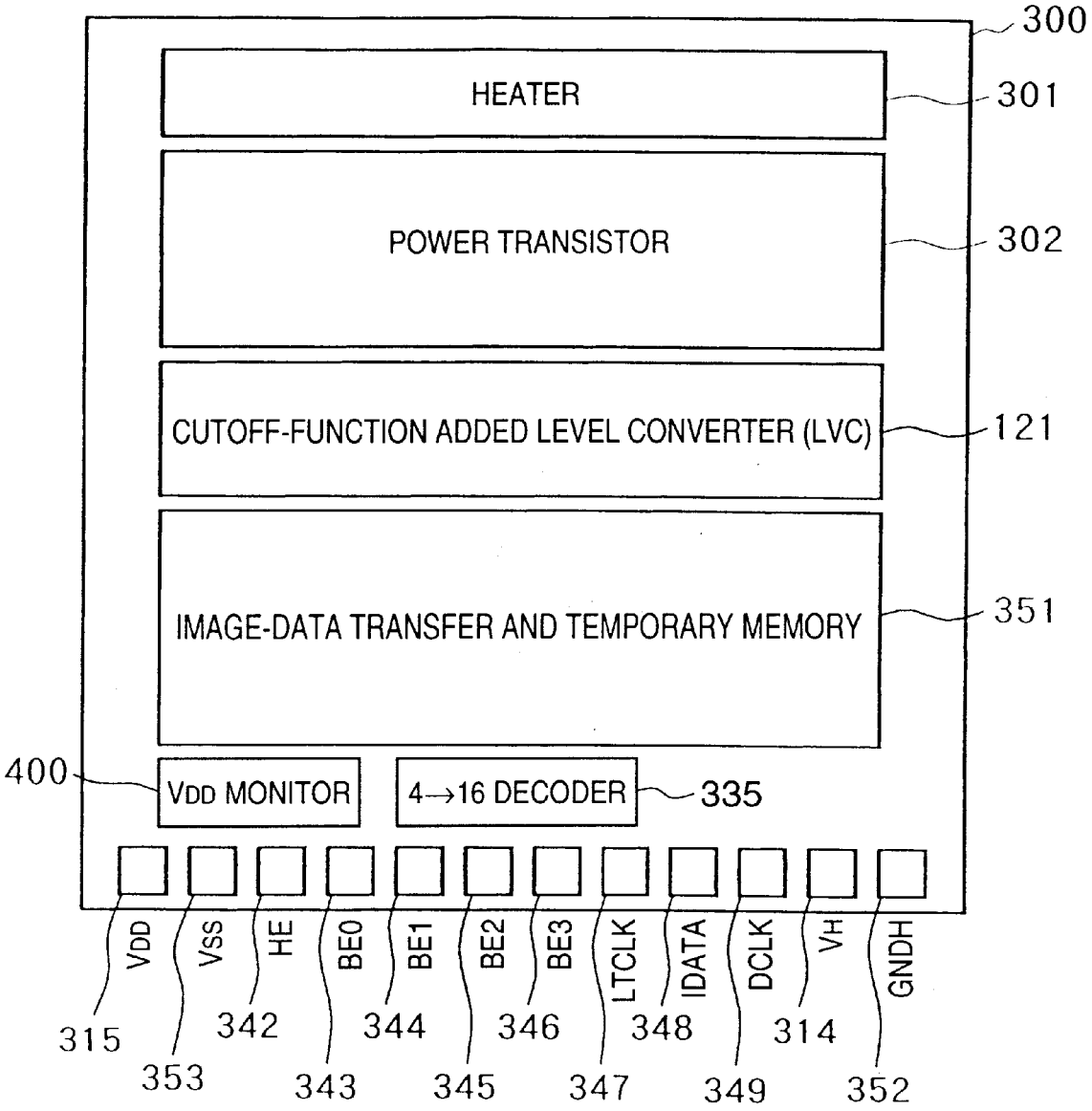
FIG. 4 is a block diagram showing the schematic construction of a driving circuit provided in a printhead IJH.

FIG. 4 is a block diagram showing the schematic construction of the driving circuit provided in the printhead IJH. In FIG. 4, constituent elements corresponding to those described in FIG. 11 have the same reference numerals and the explanations of the elements will be omitted. If comparisons are made between the input pads in FIG. 4 and those in FIG. 11, it is found that the number and the types of input signals are the same. Accordingly, the printhead IJH as shown in FIG. 4 is basically driven by using the same control signals as those shown in FIG. 11.

In this construction, a cutoff-function added level converter (LVC) 121 having a cutoff function to forcefully turn the power transistor OFF (to be described later) and a VDD monitor 400 to monitor the VDD power supply line are packaged on the circuit board 300.

Figure 5:
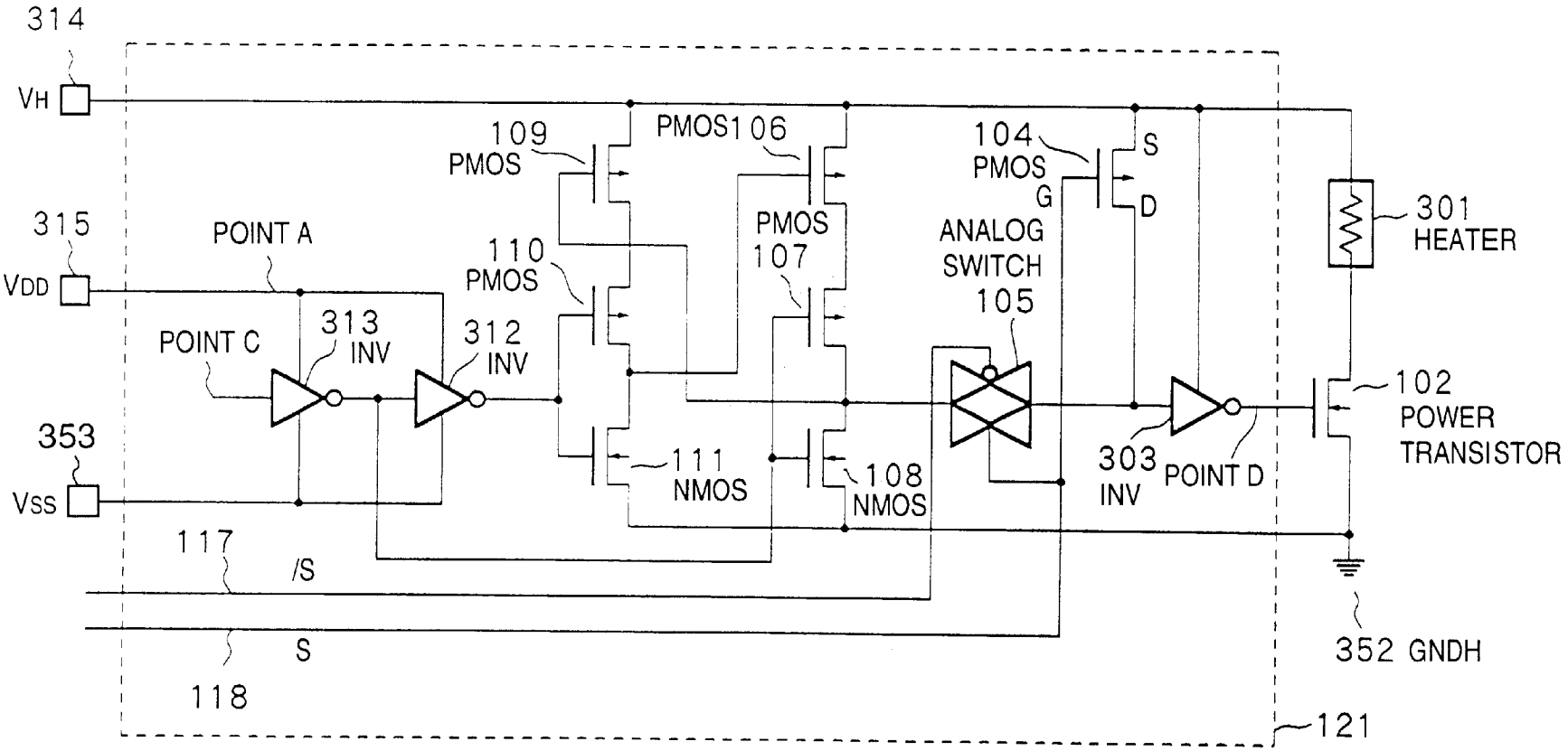
FIG. 5 is a circuit diagram showing the construction of a cutoff-function added level converter (LVC) 121.

FIG. 5 is a circuit diagram showing the construction of the cutoff-function added level converter (LVC) 121. Note that in FIG. 5, constituent elements corresponding to those described in FIG. 12 have the same reference numerals, the explanations of the elements will be omitted, and only the difference from FIG. 12 will be described.

In this example, as shown in FIG. 5, an analog switch (SW) 105 is provided between the inverter (INV) 303 and a voltage amplifying circuit comprising a PMOS transistor 106, a PMOS transistor 107, an NMOS transistor 108, a PMOS transistor 109, a PMOS transistor 110 and an NMOS transistor 111. The drain of a PMOS transistor 104 is connected to a contact between the analog switch (SW) 105 and the inverter (INV) 303, on the other hand, the source of the PMOS transistor 104 is connected to the pad 314 used for supplying the power supply voltage (VH). Further, the gate of the PMOS transistor 104 is connected to the regular input of the analog switch (SW) 105.

The line connecting the gate of the PMOS transistor 104 and the regular input of the analog switch (SW) 105 is an S signal line 118. A line of the inverse input of the analog switch (SW) 105 is a /S signal line 117. The S signal line 118 and the /S signal line 117 are output lines from the VDD monitor 400 to be described later.

Figure 6:
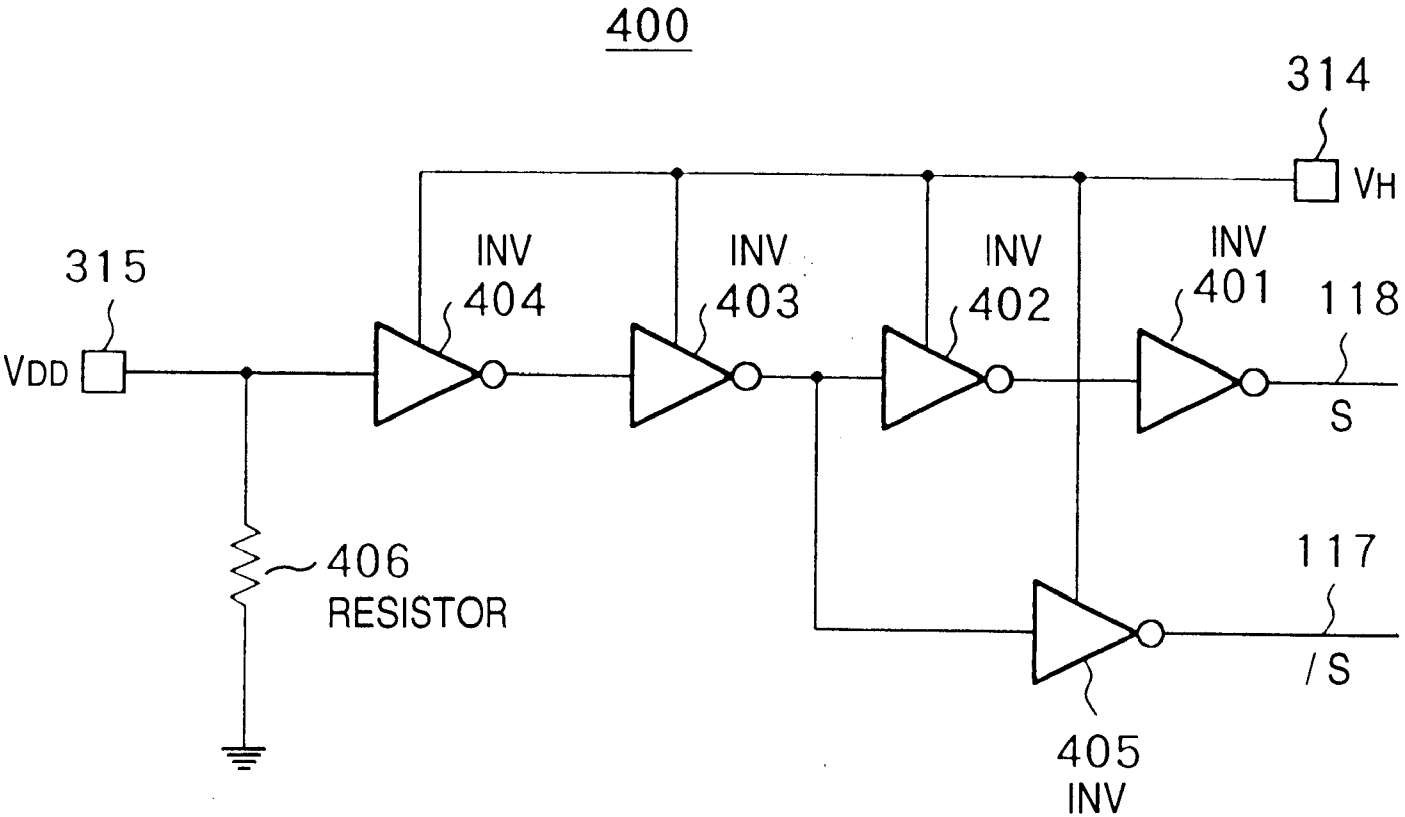
FIG. 6 is a circuit diagram showing the construction of a VDD monitor 400 to monitor a VDD power supply line.

FIG. 6 is a circuit diagram showing the construction of the VDD monitor 400 to monitor the VDD power supply line.

Note that in FIG. 6, signals and constituent elements corresponding to those already described have the same reference numerals and symbols, and the explanations of the signals and elements will be omitted.

As shown in FIG. 6, the VDD power inputted from the pad 315 is connected to a resistor 406 as a pull-down resistor which is used for quickly discharging parasitic electric charge on the VDD power supply line when the VDD power source becomes OPEN. Further, an inverter (INV) 404 is serially connected to the pad 315. On the other hand, the inverter (INV) 404 is connected to the pad 314 to which the power supply voltage VH is applied.

Further, inverters (INVs) 403, 402 and 401 are serially connected to the inverter (INV) 404. Further, an inverter (INV) 405 is connected to the output of the inverter (INV) 403 in parallel to the inverters (INVS) 402 and 401. These inverters (INVs) 401 to 403 and 405 are also connected to the pad 314 to which the power supply voltage VH is applied.

The output from the inverter (INV) 401 is connected to the S signal line 118, to be inputted into the cutoff-function added level converter 121. On the other hand, the output from the inverter (INV) 405 is connected to the /S signal line 117, to be inputted into the cutoff-function added level converter 121.

Next, the operation of the cutoff-function added level converter 121 and that of the VDD monitor 400 will be described with reference to FIGS. 7A to 7E as graphs respectively showing time change in the VDD power supply voltage.

The VDD monitor 400 inputs the VDD voltage from the pad 315, and the inverter (INV) 404 always detects the voltage. Further, a threshold level to determine the high level "H" and the low level "L" of the output from the inverter (INV) 404 is lower than the VDD voltage so as to detect a voltage drop caused by an OPEN state of the contact of the pad 315 used for inputting the VDD voltage.

Hereinbelow, a step-by-step description will be made about phenomena caused by the VDD voltage drop that occurs when the contact of the pad 315 changes from a normally-connected state to the OPEN state.

(1) When the pad 315 is normally connected and the VDD power supply voltage is at a normal level ($0 \leqq t < t1$)

In this case, as the VDD power supply voltage is higher than the threshold level of the inverter (INV) 404, the output from the inverter (INV) 404 is "L", then the output from the inverter (INV) 403 is "H", then the output from the inverter (INV) 402 is "L", then the output from the inverter (INV) 401 is "H", and the "H" level signal is outputted onto the S signal line 118. On the other hand, the output from the inverter (INV) 405 is "L", and the "L" level signal is outputted onto the /S signal line 117.

As these outputs are inputted into the cutoff-function added level converter 121, the analog switch (SW) 105 is "ON", while the PMOS transistor 104 is OFF. Accordingly, the power transistor 102 is normally controlled by the control signal.

(2) Immediately after the contacts of the pad 315 and the pad to the input control signal become OPEN ($t1 \leqq t < t1+\Delta t$)

Figure 7A:
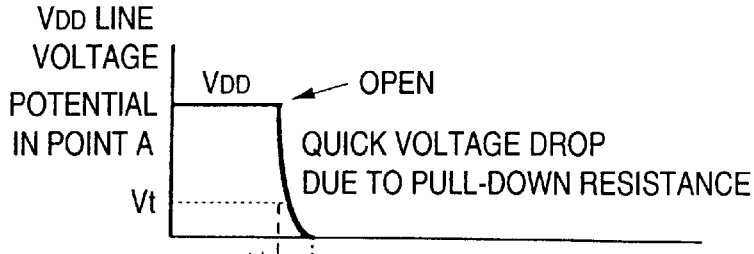
FIGS. 7A to 7E are graphs showing time change in VDD power supply voltage.

As shown in FIG. 7A, the VDD power supply voltage from the pad 315 is quickly lowered by the pull-down resistor 406. At this time, as the VDD power supply voltage becomes lower than the threshold level of the inverter (INV) 404, the output from the inverter (INV) 404 is "H". Then the output from the inverter (INV) 403 is "L", then the output from the inverter (INV) 402 is "H", then the output from the inverter (INV) 401 is "L", and the "L" level signal is outputted onto the S signal line 118. On the other hand, the output from the inverter (INV) 405 is "H", and the "H" level signal is outputted onto the /S signal line 117.

Figure 7B:
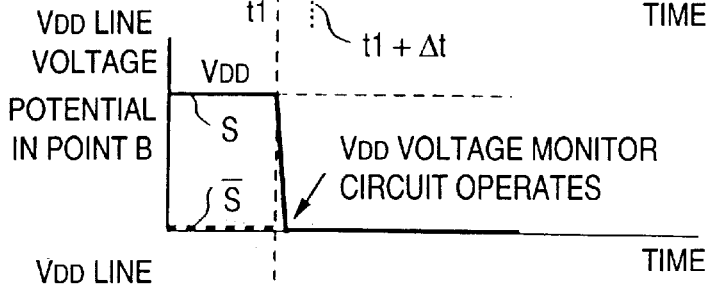
Figure 7C:
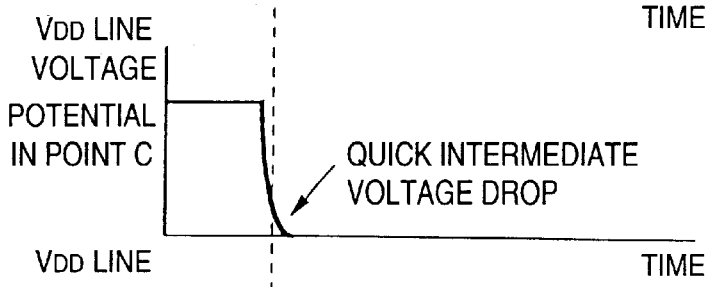

In this manner, the VDD monitor 400 quickly responds to the change in the VDD power supply voltage. As shown in FIG. 7B, the signal level of the /S signal line 117 and that of the S signal line 118 change places.

As these signals are respectively inputted into the cutoff-function added level converter 121, the analog switch (SW) 105 is OFF while the PMOS transistor 104 is ON. Accordingly, a signal outputted from the CMOS logic circuit connected to the VDD line, as an inconstant voltage, is blocked by the analog switch (SW) 105. At this time, as the inverter (INV) 303 outputs the inconstant voltage if the input of the inverter (INV) 303 is OPEN, the PMOS transistor is turned ON to output the drain current, so that the input level of the inverter (INV) 303 is fixed at "H". Thus, the output from the inverter (INV) 303 is at "L", and the power transistor 102 is forcefully turned OFF.

Figure 7D:
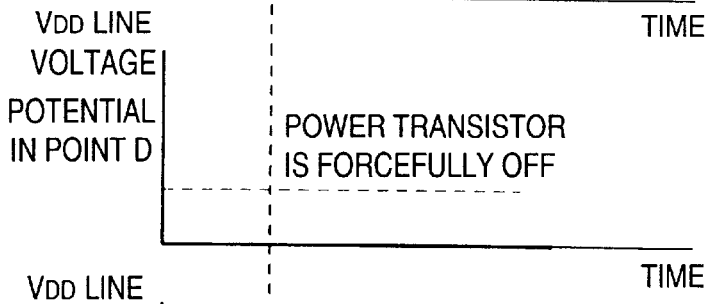
Figure 7E:
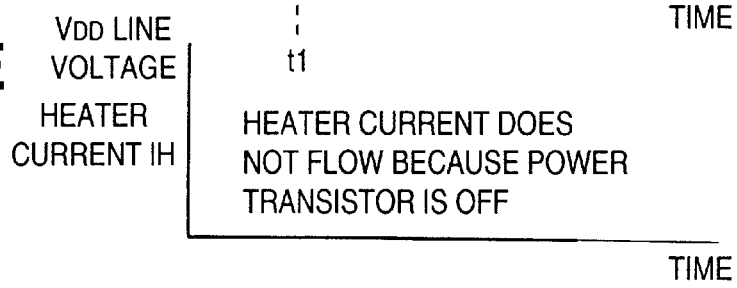

As shown in FIG. 7D, the voltage in the point D in FIG. 5 is not higher than the operation threshold voltage (Vth) of the power transistor 102. As a result, the power transistor 102 does not operate, and the current does not flow through the heater 301. That is, as shown in FIG. 7E, the value of the heater current (IH) is still "0".

According to the present embodiment as described above, even if the connection becomes poor between electrical contacts between the printhead and the printing apparatus holding the printhead, and the contacts of pads to input the VDD power supply voltage and the control signals, for example, become OPEN, the voltage applied to the power transistor is forcefully lowered to "0". This prevents application of a voltage, higher than the operation threshold voltage of the power transistor which drives the heater, to the power transistor, and prevents malfunction of the power transistor.

Accordingly, malfunction of the heater, heat generation in the heater, ink discharge due to the heat generation, and breakage of the heater by overheating can be prevented.

[Other Embodiments]

The construction of the cutoff-function added level converter (LVC) 121 and that of the VDD monitor 400 are not limited to those described in the above embodiment. In this embodiment, other constructions of the cutoff-function added level converter (LVC) 121 to forcefully turn the power transistor OFF and the VDD monitor 400 will be described.

Figure 8:
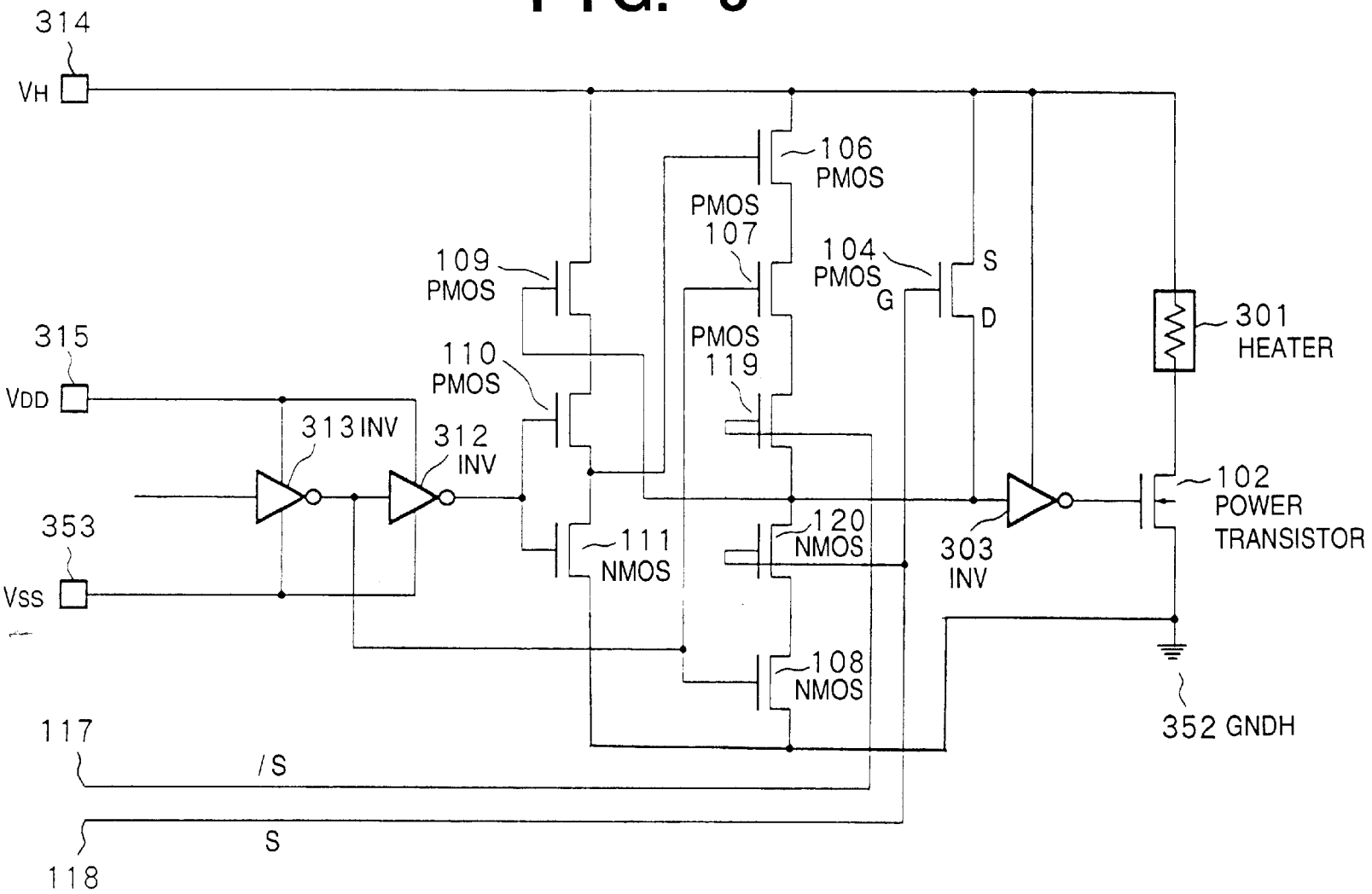
FIG. 8 is a circuit diagram showing the construction of the cutoff-function added level converter (LVC) 121 according to another embodiment of the present invention.

FIG. 8 is a circuit diagram showing the construction of the cutoff-function added level converter (LVC) 121 according to this embodiment. Note that in FIG. 8, constituent elements and signals corresponding to those already described in FIGS. 5 and 12 have the same reference numerals and symbols, the explanations of the elements and signals will be omitted, and only constructions and operations characteristic of this embodiment will be described.

As shown in FIG. 8, a PMOS transistor 119 is provided between the PMOS transistor 107 and the input of the inverter (INV) 303. An NMOS transistor 120 is provided between the NMOS transistor 108 and the input of the inverter (INV) 303. The source of the PMOS transistor 119 is connected to the drain of the PMOS transistor 107, and the drain of the PMOS transistor 119 is connected to the input of the inverter (INV) 303 and the drain of the NMOS transistor 120. The source of the NMOS transistor 120 is connected to the drain of the NMOS transistor 108.

On the other hand, the drain of the PMOS transistor 104 is connected to the common contact between the drain of the PMOS transistor 119 and that of the NMOS transistor 120, and the source of the PMOS transistor 104 is connected to the pad 314 to receive the power supply voltage VH. The gate of the PMOS transistor 104, and the gate of the NMOS transistor 120, are connected to the S signal line 118. On the other hand, the gate of the PMOS transistor 119 is connected to the /S signal line 117.

As described in the above embodiment, the S signal line 118 and the /S signal line 117 are output lines from the VDD monitor 400.

Figure 9:
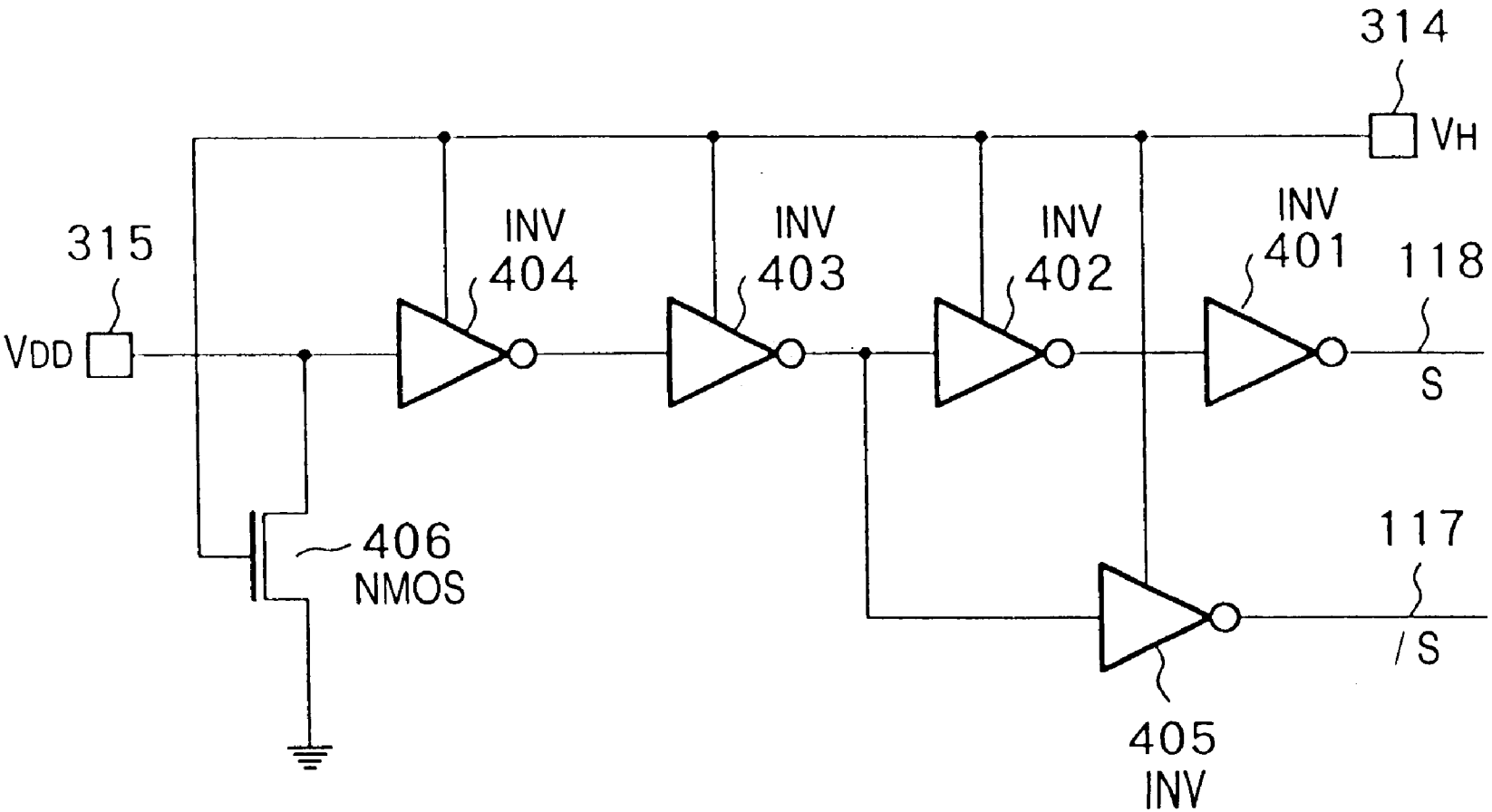
FIG. 9 is a circuit diagram showing the construction of the VDD monitor 400 according to still another embodiment.

FIG. 9 is a circuit diagram showing the construction of the VDD monitor 400 according to the present embodiment.

Note that in FIG. 9, constituent elements and signals corresponding to those already described in FIG. 6 of the previous embodiment have the same reference numerals and symbols, the explanations of the elements and signals will be omitted, and only the difference from FIG. 6 will be described.

As shown in FIG. 9, in the present embodiment, an NMOS transistor 406 is used as a pull-down resistor for the VDD power supply voltage line inputted from the pad 315. The pull-down resistor is employed to quickly discharge electric charge of parasitic capacitance on the VDD power supply voltage line when the contact of the pad 315 becomes OPEN. The construction except this element is the same as that of the VDD monitor of the previous embodiment.

Next, the operation of the cutoff-function added level converter 121 and that of the VDD monitor according to the present embodiment will be described.

As in the case of the above embodiment, the threshold level of the inverter (INV) 404 is lower than the VDD power supply voltage such that the VDD monitor can detect OPEN state of the contact of the pad 315.

(1) When the pad 315 is normally connected and the VDD power supply voltage is at a normal level As in the case of the above embodiment, the "H" level signal is outputted onto the S signal line 118, while the "L" level signal is outputted onto the /S signal line 117. These signals are respectively inputted into the cutoff-function added level converter 121, and the PMOS transistor 119 and the NMOS transistor 120 are ON, while the PMOS transistor 104 is OFF. Accordingly, the power transistor 102 is normally controlled by the control signal.

(2) Immediately after the contacts of the pad 315 and the pad to input the control signal become OPEN The VDD power supply voltage from the pad 315 is quickly lowered by the NMOS transistor 406 as the pull-down resistor. At this time, the output from the inverter (INV) 404 is at the "H" level. As in the case of the previous embodiment, the "L" level signal is outputted onto the S signal line 118 while the "H" level signal is outputted onto the /S signal line 117.

At this time, these signals are respectively inputted into the cutoff-function added level converter 121, and the PMOS transistor 119 and the NMOS transistor 120 are OFF, while the PMOS transistor 104 is ON.

Accordingly, the signal outputted from the CMOS logic circuit connected to the VDD line, as an inconstant voltage, is blocked by the PMOS transistor 119 and the NMOS transistor 120. At this time, the input to the inverter (INV) 303 is fixed at the "H" level by maintaining the ON state of the PMOS transistor 104. Thus, the output from the inverter (INV) 303 is forcefully "L". The power transistor 102 does not operate, and the heater current does not flow through the heater 301.

As described above, in the present embodiment, the NMOS transistor is employed as the pull-down resistor of the VDD monitor, and the analog switch of the cutoff-function added level converter is replaced with the PMOS transistor and the NMOS transistor. By this arrangement, even if the contacts of the pads to input the VDD power supply voltage and the control signal become OPEN, the voltage to be applied to the power transistor is forcefully lowered to "0", as in the case of the above embodiment. Thus the malfunction of the heater can be prevented.

Figure 10:
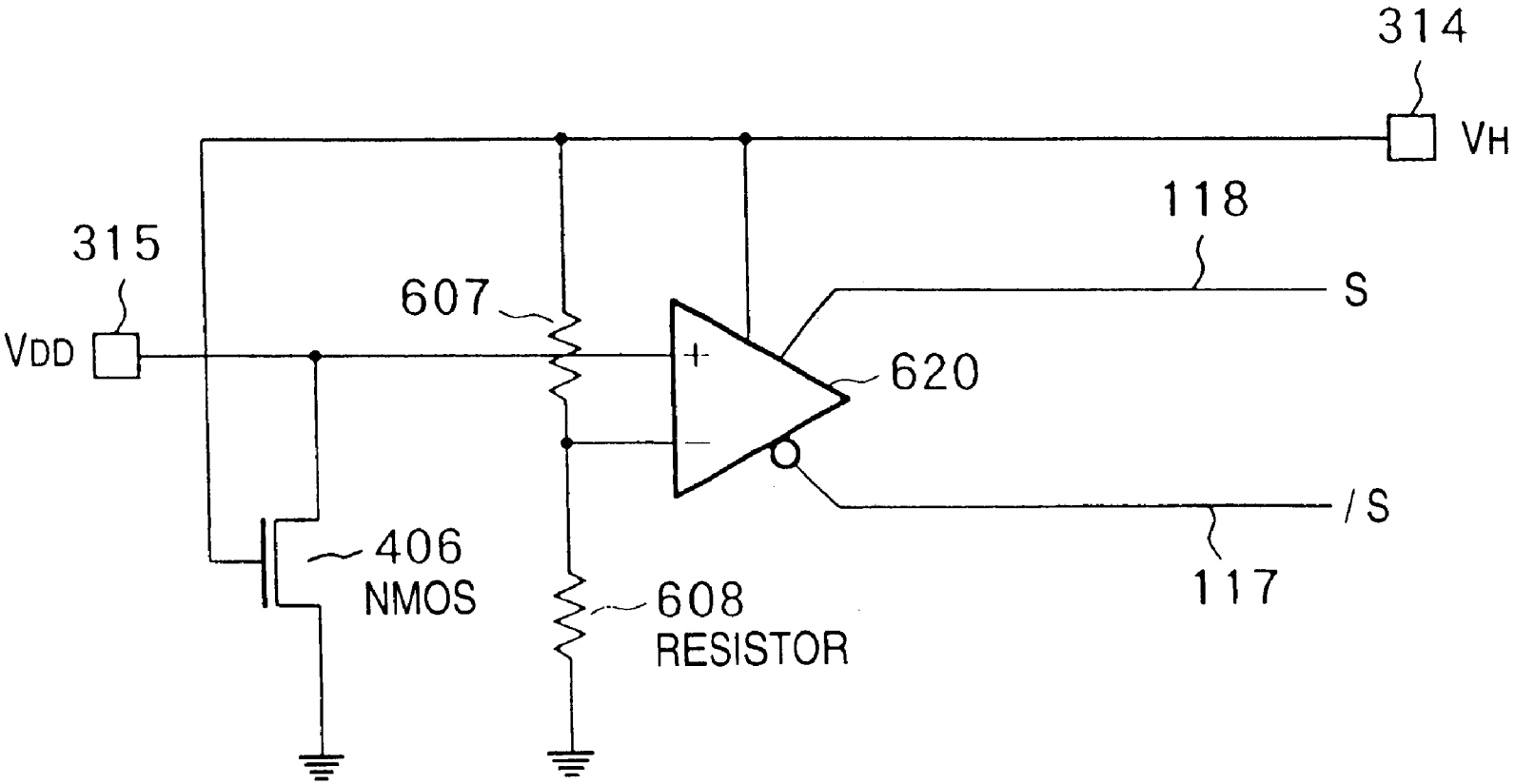
FIG. 10 is a circuit diagram showing the construction of the VDD monitor according to yet still another embodiment of the present invention.

Note that the construction of the VDD monitor is not limited to the above embodiments. A circuit having a construction as shown in FIG. 10, for example, may be used as the VDD monitor. Note that in FIG. 10, constituent elements and signals corresponding to those already described in FIGS. 6 and 9 in the above two embodiments have the same reference numerals and symbols.

Hereinbelow, the characteristic construction and operation of the circuit as shown in FIG. 10 will be described.

In this construction, the pad 315 to receive the VDD power is connected to the positive (+) input of a regular/inverse output type voltage comparator (COMP) 620. The NMOS transistor 406 as the pull-down resistor is connected to the VDD power supply line from the pad 315. On the other hand, the power source of the voltage comparator (COMP) 620 is the power supply voltage VH supplied from the pad 314. The regular output from the voltage comparator (COMP) 620 is connected to the S signal line 118, while the inverse output from the voltage comparator is connected to the /S signal line 117.

Further, a resistor 607 is connected to the pad 314 to which the power supply voltage VH is supplied, and a resistor 608 is connected to the GND. As shown in FIG. 10, the resistors 607 and 608 are serially connected between the power supply voltage VH and the GND, and their common contact is connected to the negative (−) input of the voltage comparator (COMP) 620. Accordingly, the voltage divided by the resistors 607 and 608 is a reference voltage for monitoring the VDD voltage inputted from the pad 315.

By this arrangement, (1) when the pad 315 is normally connected and the VDD power is normally supplied, the VDD voltage is higher than the reference voltage. Accordingly, the "H" level signal is outputted onto the S signal line 118, while the "L" level signal is outputted onto the /S signal line 117. On the other hand, (2) when the contacts of the pad 315 and the pad to input the control signal are OPEN, the VDD power supply voltage is quickly lowered by the NMOS transistor 406 and the VDD power supply voltage becomes lower than the reference voltage. As a result, the "L" level signal is outputted onto the S signal line 118, while the "H" level signal is outputted onto the /S signal line 117.

Thereafter, as described above, these S signal and /S signal are inputted into the cutoff-function added level converter.

Note that in the above embodiments, the safety circuit is constructed on the presumption that the VDD power supply line and the control signal line become OPEN while the VH power is normally supplied. If the VDD power supply line and the control signal line are normally connected while the contact to supply the VH power becomes OPEN and the VH power is not supplied, it is impossible to pass the heater current through the heater (i.e., power supply voltage is not supplied). As described above, the OPEN state of the VDD power supply line and that of the control signal line is considered as a precondition for malfunction, and the circuit is constructed such that it does not malfunction on the precondition.

Further, in the above embodiments, as the circuit is formed with the heater on the same substrate, they can be integrally formed at the same semiconductor manufacturing process. Thus a low-price safety circuit can be easily manufactured without increasing costs.

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive an ink from the apparatus main body upon being mounted on the apparatus main body can be applicable to the present invention as well as the cartridge type printhead in which an ink tank is integrally arranged on the printhead itself as described in the above embodiment.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In the present invention, the above-mentioned film boiling system is most effective for the above-mentioned inks.

In addition, the ink-jet printer of the present invention may be used in the form of a copying machine combined with a reader and the like, or a facsimile apparatus having a transmission/reception function in addition to an image output terminal of an information processing apparatus such as a computer.

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can be also achieved by providing a storage medium storing program code for performing the aforesaid processes to a system or an apparatus, reading the program code with a computer (e.g., CPU, MPU) of the system or apparatus from the storage medium, then executing the program.

In this case, the program code read from the storage medium realize the functions according to the embodiments, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, besides aforesaid functions according to the above embodiments are realized by executing the program code which are read by a computer, the present invention includes a case where an OS (operating system) or the like working on the computer performs a part or entire processes in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printhead, supplied with a control signal, print data and electric power supplied via a plurality of electrical contacts, for performing printing operations, comprising:

a printing element;

a first contact that inputs a voltage to drive said printing element;

a control circuit that performs drive control on said printing element;

a second contact that inputs a voltage to drive said control circuit;

a monitoring circuit that monitors the control circuit drive voltage input at said second contact; and a protection circuit that stops driving of said printing element by said control circuit, in accordance with the result of monitoring by said monitoring circuit.

2. The printhead according to claim 1, wherein said printing element includes a heater and a power transistor to electrify said heater.

3. The printhead according to claim 2, wherein said heater heats ink to cause film boiling in said ink, and discharge said ink by a pressure of a bubble generated by said film boiling.

4. The printhead according to claim 1, further comprising:

a third contact that inputs print data; and a memory circuit that is used for temporarily storing the print data inputted via said third contact.

5. The printhead according to claim 4, wherein said control circuit inputs a signal representing the print data stored in said memory circuit, and amplifies the voltage of said signal.

6. The printhead according to claim 5, wherein said control circuit is a CMOS circuit comprising a PMOS transistor and an NMOS transistor.

7. The printhead according to claim 1, wherein said protection circuit includes an analog switch and a PMOS transistor.

8. The printhead according to claim 1, wherein said protection circuit includes a switch comprising a pair of a first PMOS transistor and an NMOS transistor and a second PMOS transistor.

9. The printhead according to claim 1, wherein said monitoring circuit operates by the voltage inputted from said first contact.

10. The printhead according to claim 9, wherein said monitoring circuit comprises a comparator having a first terminal connected to said second contact and a second terminal to input a voltage obtained by dividing the voltage inputted from said first contact by serially-connected first and second resistors.

11. A printhead, supplied with a control signal, print data and electric power supplied via a plurality of electrical contacts, for performing printing operations, comprising:

a printing element;

a first contact that inputs a voltage to drive said printing element;

a control circuit that performs drive control on said printing element;

a second contact that inputs a voltage to drive said control circuit;

a monitoring circuit that monitors the voltage in said second contact; and a protection circuit that stops driving of said printing element by said control circuit, in accordance with the result of monitoring by said monitoring circuit, wherein said protection circuit includes an analog switch and a PMOS transistor, said analog switch cuts off an output from said control circuit in accordance with the result of monitoring from said monitoring circuit, and said PMOS transistor forcefully turns off an output to said printing element.

12. A printhead, supplied with a control signal, print data and electric power supplied via a plurality of electrical contacts, for performing printing operations, comprising:

a printing element;

a first contact that inputs a voltage to drive said printing element;

a control circuit that performs drive control on said printing element;

a second contact that inputs a voltage to drive said control circuit;

a monitoring circuit that monitors the voltage in said second contact; and a protection circuit that stops driving of said printing element by said control circuit, in accordance with the result of monitoring by said monitoring circuit, wherein said protection circuit includes a switch comprising a pair of a first PMOS transistor and an NMOS transistor and a second PMOS transistor, said switch comprising the pair of said first PMOS transistor and said NMOS transistor cuts off an output from said control circuit in accordance with the result of monitoring from said monitoring circuit, and said second PMOS transistor forcefully turns off an output to said printing element.

13. A printhead, supplied with a control signal, print data and electric power supplied via a plurality of electrical contacts, for performing printing operations, comprising:

a printing element;

a first contact that inputs a voltage to drive said printing element;

a control circuit that performs drive control on said printing element;

a second contact that inputs a voltage to drive said control circuit;

a monitoring circuit that monitors the voltage in said second contact; and a protection circuit that stops driving of said printing element by said control circuit, in accordance with the result of monitoring by said monitoring circuit, wherein said monitoring circuit operates by the voltage inputted from said first contact, and said monitoring circuit comprises a plurality of inverter circuits connected to said second contact and a pull-down resistor connected to said second contact.

14. A printing apparatus using the printhead claimed in any one of claims 1 to 10.

* * * * *

UNITED STATES PATENT AND TRADEMARK OFFICE

CERTIFICATE OF CORRECTION

PATENT NO. : 6,471,324 B1
DATED : October 29, 2002
INVENTOR(S) : Hiroyuki Maru

It is certified that error appears in the above-identified patent and that said Letters Patent is hereby corrected as shown below:

Column 18,
Line 47, "10." should read -- 13. --.

Signed and Sealed this

Twenty-sixth Day of July, 2005

JON W. DUDAS
*Director of the United States Patent and Trademark Office*